US008453415B2

(12) United States Patent
Brunnhofer et al.

(10) Patent No.: US 8,453,415 B2
(45) Date of Patent: Jun. 4, 2013

(54) SPACER PROFILE FOR A SPACER FRAME FOR AN INSULATING WINDOW UNIT AND INSULATING WINDOW UNIT

(75) Inventors: Erwin Brunnhofer, Fuldabrück (DE); Petra Sommer, Helsa (DE); Jörg Lenz, Habichtswald (DE)

(73) Assignee: Technoform Glass Insulation Holding GmbH (DE)

( * ) Notice: Subject to any disclaimer, the term of this patent is extended or adjusted under 35 U.S.C. 154(b) by 338 days.

(21) Appl. No.: 12/643,349

(22) Filed: Dec. 21, 2009

(65) Prior Publication Data

US 2010/0107526 A1 May 6, 2010

Related U.S. Application Data

(62) Division of application No. 11/575,020, filed as application No. PCT/EP2005/009349 on Aug. 30, 2005, now Pat. No. 7,827,760.

(51) Int. Cl.
*E04C 2/54* (2006.01)

(52) U.S. Cl.
USPC ..... 52/786.13; 52/788.1; 52/309.13

(58) Field of Classification Search
USPC ..... 52/786.1, 786.11, 786.13, 788.1, 52/795.1, 800.1, 656.5, 204.593, 171.3, 172; 428/34
See application file for complete search history.

(56) References Cited

U.S. PATENT DOCUMENTS 4,109,431 A * 8/1978 Mazzoni et al. ..... 52/172
4,222,213 A 9/1980 Kessler
4,984,402 A * 1/1991 Davies ..... 52/204.593
5,079,054 A 1/1992 Davies
5,260,112 A 11/1993 Grether et al.

(Continued)

FOREIGN PATENT DOCUMENTS

CN 1271401 10/2000
DE 33 02 659 8/1984

(Continued)

OTHER PUBLICATIONS

International Search Report mailed Dec. 30, 2005 for International Application No. PCT/EP2005/009349.

(Continued)

*Primary Examiner* — Joshua J Michener
*Assistant Examiner* — Chi Q Nguyen
(74) *Attorney, Agent, or Firm* — Tucker Ellis LLP

(57) ABSTRACT

A spacer profile (50) for a spacer profile frame mountable in the edge area of an insulating window unit for forming an intervening space (53) between window panes (51, 52), has a profile body (10) made of synthetic material and comprises one or more chambers (20) for accommodating hygroscopic material. A metal film (30) encloses the profile body on three-sides such that, in the bent/assembled state of the spacer profile, the non-enclosed inner side of the profile body is directed towards the intervening space between the window panes. The not-enclosed inner side of the profile body comprises openings (15) for moisture exchange between hygroscopic material accommodated in the chamber(s) and the intervening space between the window panes. The metal film comprises a profile (31*a-g*, 32*a-g*) on each end directed towards the intervening space of the window panes. Each profile has at least one edge or bend.

15 Claims, 6 Drawing Sheets

U.S. PATENT DOCUMENTS

| | | | | |
|---|---|---|---|---|
| 5,313,761 | A | 5/1994 | Leopold | |
| 5,313,762 | A | 5/1994 | Guillemet | |
| 5,460,862 | A * | 10/1995 | Roller | 428/35.7 |
| 5,485,709 | A | 1/1996 | Guillemet | |
| 5,512,341 | A | 4/1996 | Newby et al. | |
| 5,630,306 | A | 5/1997 | Wylie | |
| 5,675,944 | A | 10/1997 | Kerr | |
| 5,890,289 | A | 4/1999 | Guillemet et al. | |
| 5,962,090 | A | 10/1999 | Trautz | |
| 6,035,602 | A | 3/2000 | Lafond | |
| 6,038,825 | A | 3/2000 | Shah | |
| 6,061,994 | A | 5/2000 | Goer et al. | |
| 6,068,720 | A | 5/2000 | McHugh | |
| 6,192,652 | B1 | 2/2001 | Goer et al. | |
| 6,250,045 | B1 | 6/2001 | Goer et al. | |
| 6,339,909 | B1 | 1/2002 | Brunnhofer et al. | |
| 6,389,779 | B1 | 5/2002 | Brunnhofer | |
| 6,613,404 | B2 * | 9/2003 | Johnson | 428/34 |
| 6,989,188 | B2 | 1/2006 | Brunnhofer et al. | |
| 2005/0100691 | A1 | 5/2005 | Bunnhofer | |
| 2010/0107526 | A1 | 5/2010 | Brunnhofer | |

FOREIGN PATENT DOCUMENTS

| | | | |
|---|---|---|---|
| DE | 195 33 685 | A1 | 3/1997 |
| DE | 198 05 348 | | 8/1999 |
| DE | 198 32 731 | A1 | 6/2000 |
| DE | 102 26 268 | A1 | 10/2003 |
| DE | 103 11 830 | A1 | 9/2004 |
| EP | 0 601 488 | A2 | 6/1994 |
| EP | 0 953 715 | A | 11/1999 |
| EP | 1 017 923 | | 8/2001 |
| JP | S61-11237 | | 4/1994 |
| JP | 11-247540 | | 9/1999 |
| JP | 2000-320047 | | 11/2000 |
| UA | 81001 | | 11/2007 |
| WO | WO 99/15753 | | 4/1999 |
| WO | WO 03/074830 | | 9/2003 |

OTHER PUBLICATIONS

U.S. Appl. No. 11/038,765, filed Aug. 25, 2005, Erwin Brunnhofer.
U.S. Appl. No. 11/575,020, filed Dec. 6, 2008, Erwin Brunnhofer.
Japanese Examination Report. Dispatch No. 203583; Mailing date: Mar. 30, 2010.

* cited by examiner b)

a) b)

| | a) D in | b) 0 in | a ▸ | b) |
|---|---|---|---|---|
| Fig.10 | 42,5 | 31,5 | 0.% | 0 % |
| Fig. 4 | 31 | 2'0 | —27% | —37% |
| Fiq. 5 | 26 | 20 | —39 % | — |
| Fiq. 6 | 26 | 17 | —39% | —46 |
| Fig. 7 | 30,5 | 20 | —28% | —37% |
| Fig. 8 | 31,5 | 22 | —26% | —30% |
| Fig. 9 | 34 | 22 | —20% | —30% |

C

| | a) | b) |
|---|---|---|
| Hg.10 | | |
| Hg.4 | + | + |
| Fig.5 | + | + |
| Hq.6 | + | + |
| Fiq.7 | ++ | ++ |
| Fiq.B | + | + |
| Hg.9 | ++ | + +- |
| Fiq.11 | -F | -1-- |

SPACER PROFILE FOR A SPACER FRAME FOR AN INSULATING WINDOW UNIT AND INSULATING WINDOW UNIT

CROSS-REFERENCE

This application is a division of U.S. patent application Ser. No. 11/575,020, filed on Dec. 7, 2007 now U.S. Pat. No. 7,827,760, which claims the benefit of priority of PCT Patent Application No. PCT/EP2005/009349, filed Aug. 30, 2005.

TECHNICAL FIELD

The present invention relates to spacer profiles and to insulating window units incorporating the present spacer profiles.

DESCRIPTION OF THE BACKGROUND ART

Insulating window units having at least two window panes, which are held apart from each other in the insulating window unit, are known. Insulating windows are normally formed from an inorganic or organic glass or from other materials like Plexiglas. Normally, the separation of the window panes is secured by a spacer frame (see reference number 50 in FIG. 1). The spacer frame is either assembled from several pieces using connectors or is bent from one piece (see FIG. 2), so that then the spacer frame 50 is closable by a connector 54 at only one position.

Various designs have been utilized for insulating window units that are intended to provide good heat insulation. According to one design, the intervening space between the panes is preferably filled with inert, insulating gas, e.g., such as argon, krypton, xenon, etc. Naturally, this filling gas should not be permitted leak out of the intervening space between the panes. Consequently, the intervening space between the panes must be sealed accordingly. Moreover, nitrogen, oxygen, water, etc., contained in the ambient air naturally also should not be permitted enter into the intervening space between the panes. Therefore, the spacer profile must be designed so as to prevent such diffusion. In the description below, when the term "diffusion impermeability" is utilized with respect to the spacer profiles and/or the materials forming the spacer profile, vapor diffusion impermeability, as well as also gas diffusion impermeability for the gases relevant herein, are meant to be encompassed within the meaning thereof.

Furthermore, the heat transmission of the edge connection, i.e. the connection of the frame of the insulating window unit, of the window panes, and of the spacer frame, in particular, plays a very large role for achieving low heat conduction of these insulating window units. Insulating window units, which ensure high heat insulation along the edge connection, fulfill "warm edge" conditions as this term is utilized in the art.

Conventionally, spacer profiles were manufactured from metal. Such metal spacer profiles can not, however, fulfill "warm edge" conditions. Thus, in order to improve upon such metal spacer profiles, the provision of synthetic material on the metal spacer profile has been described, e.g., in U.S. Pat. No. 4,222,213 or DE 102 26 268 A1.

Although a spacer, which exclusively consists of a synthetic material having a low heat conduction value, could be expected to fulfill the "warm edge" conditions, the requirements of diffusion impermeability and strength would be very difficult to satisfy.

Other known solutions include spacer profiles made of synthetic material that are provided with a metal film as a diffusion barrier and reinforcement layer, as shown, e.g., in EP 0 953 715 A2 (family member U.S. Pat. No. 6,192,652) or EP 1 017 923 (family member U.S. Pat. No. 6,339,909).

Such composite spacer profiles use a profile body made of synthetic material with a metal film, which should be as thin as possible in order to satisfy the "warm edge" conditions, but should have a certain minimum thickness in order to guarantee diffusion impermeability and strength.

Because metal is a substantially better heat conductor than synthetic material, it has been attempted, e.g., to design the heat conduction path between the side edges/walls of the spacer profile (i.e. through or via the metal film) to be as long as possible (see EP 1 017 923 A1).

For improved gas impermeability, the spacer frame is preferably bent from a one-piece spacer profile, if possible by cold bending (at a room temperature of approximately 20° C.), whereby only one position that potentially impairs the gas impermeability is provided, i.e. the gap between the respective ends of the bent spacer frame. A connector is affixed to the bent spacer frame in order to close and seal this gap.

When the spacer profile is bent, in particular when cold bending techniques are used, there is a problem of wrinkle formation at the bends (see FIG. 3*c*). The advantage of cold bending is, as was already mentioned above, that superior diffusion impermeability and increased durability of the insulating window unit result.

According to the solution known from EP 1 017 923 A1, the problem of wrinkle formation has been well solved, but the space available in the chamber for the desiccating material is not satisfactory, in particular for small distances between panes, i.e. separation distances less than 12 mm, and more particularly for separation distances of 6, 8 or 10 mm. According to other solutions, such as those shown, e.g., in FIG. 1 of EP 0 953 715 A2, the problem of wrinkle formation in the bends, in particular, still remains. Moreover, according to both solutions, when the spacer profile is intended to be utilized in a large frame, the problem of considerable sag along unsupported, lengthy portions of the spacer profile exists (see FIGS. 3*a* and 3*b*).

A composite spacer profile is also known from EP 0 601 488 A2 (family member U.S. Pat. No. 5,460,862), wherein a stiffening support is embedded on the side of the profile that faces toward the intervening space between the panes in the assembled state.

SUMMARY OF THE INVENTION

It is an object of the invention to provide improved spacer profiles, which preferably fulfill the "warm edge" conditions and reduce the problem of wrinkle formation while maximizing the chamber volume for the desiccating material. Improved methods for manufacturing such spacer profiles and improved insulating window unit with such spacer profiles are alternate objects of the invention.

One or more of these objects is/are solved by the invention (s) of the independent claim(s).

Further developments of the invention are provided in the dependent claims.

According to the present teachings, a spacer profile may preferably comprise a profile body made of synthetic material. One or more chambers for accommodating hygroscopic material are preferably defined within the profile body. A metal film preferably substantially or completely encloses the profile body on three-sides, e.g. an outer side and two side walls thereof. In addition, the metal film preferably has sufficient thickness to serve as a gas/vapor impermeable (diffusion-proof or essentially diffusion-proof) layer. Preferably, when the spacer profile is bent into a spacer profile frame and disposed between two window panes, the (e.g., inner) side of the profile body that is not covered with the metal film is arranged to be directed towards the intervening space between two window panes of an insulating window unit.

In addition, the not-enclosed (not-metal covered) inner side of the profile body preferably comprises openings and/or one or more materials adapted to facilitate moisture exchange between hygroscopic material, which is preferably accommodated in the chamber(s) when the spacer profile its final assembled state, and the intervening space between the window panes.

In addition, each end of the metal film (diffusion barrier) preferably comprises a profile (or elongation portion) formed adjacent to the respective side walls and close to the inner side of the spacer profile that will face toward the intervening space between the window panes in the bent/assembled state. The profile(s) or elongation portion(s) preferably may include at least one edge, angled portion and/or bend. In preferred embodiments, the profile(s) may define a flange with respect to the portion of the metal film covering or disposed on the side walls of the profile body.

Such spacer profiles preferably may be used as spacer profile frames, which may be mounted along the edge area of an insulating window unit for forming and securing the intervening space between the window panes. Thus, the present teachings encompass insulating window units comprising at least two window panes and one or more of the spacer profiles disclosed herein.

When the spacer profiles include the above-mentioned metal profiles, the sag along unsupported, extended portions of the spacer frame also preferably can be reduced, preferably significantly reduced, especially when using the spacer profile for large frames.

If the profile or elongation portion has a bent, angled and/or folded configuration, the length (in the cross-section perpendicular to the longitudinal direction) of the profile or elongation portion, and thus the mass of the diffusion barrier film additionally introduced in this region or area of the spacer profile, can be significantly increased. A displacement of the bend line results therefrom, which further results in a reduction of wrinkle formation. Furthermore, the sag is substantially reduced, because the bent, angled and/or folded profile/elongation portion adds significant strength to the structural integrity of the bent spacer frame.

Additional features and objects will be apparent from the description of the exemplary embodiments with consideration of the figures.

BRIEF DESCRIPTION OF THE DRAWINGS

FIGS. 11*a*) and 11*b*) show cross-section views of a spacer profile according to a seventh embodiment, respectively in a W-configuration and in a U-configuration.

DETAILED DESCRIPTION OF THE INVENTION

Figure 8:
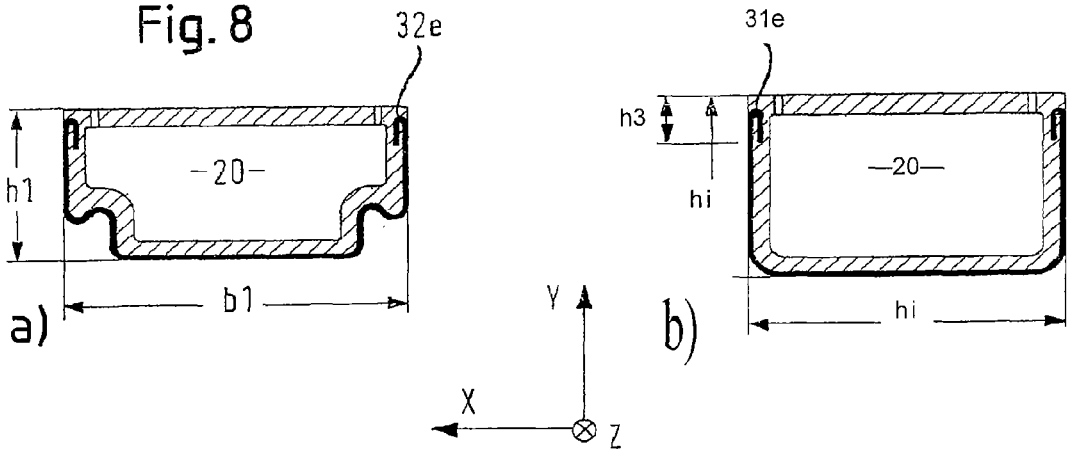
FIGS. 8*a*) and 8*b*) show a cross-sectional view of a spacer profile according to a fifth embodiment, respectively in a W-configuration and in a U-configuration.
Figure 9:
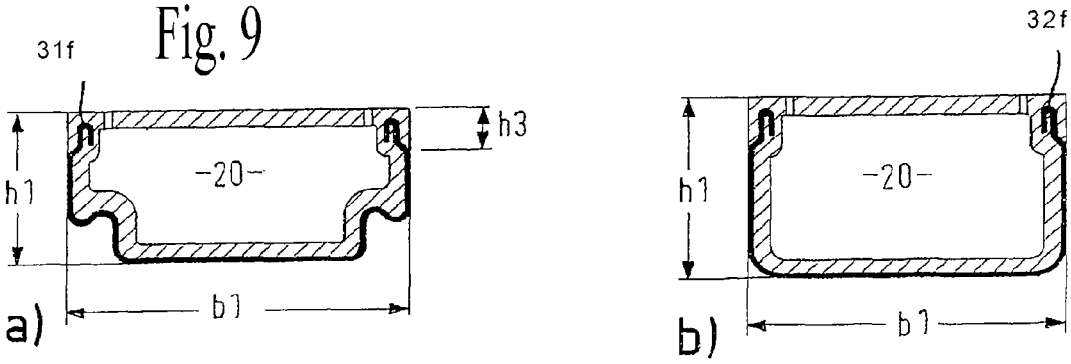
FIGS. 9*a*) and 9*b*) show a cross-sectional view of a spacer profile according to a sixth embodiment, respectively in a W-configuration and in a U-configuration.

Embodiments of the present teachings will be described in greater detail below with references to the figures. The same features/elements are marked with the same reference numbers in all figures. For the purpose of clarity, all reference numbers have not been inserted into all figures. The 3-dimensional (X, Y, Z) reference system shown in FIG. 1, between FIGS. 5 and 6 and between FIGS. 8 and 9 is applicable to all figures and the description and the claims. The longitudinal direction corresponds to the direction Z, the traverse direction corresponds to the direction X and the height direction corresponds to the direction Y.

In FIGS. 1, 4-9 and 11, a so-called W-configuration of the spacer profile is shown in each a) view and a so-called U-configuration is shown in each b) view. A spacer profile according to a first embodiment will now be described with reference to FIGS. 4*a*) and 4*b*).

In FIGS. 4*a*) and 4*b*), the spacer profile is shown in cross-section perpendicular to a longitudinal direction, i.e. along a slice in the X-Y plane, and extends with this constant cross-section in the longitudinal direction. The spacer profile comprises a height h1 in the height direction Y and is comprised of a profile body 10, which is formed from a first material. The first material is preferably an elastic-plastic deformable, poor heat conducting (insulating) material.

Herein, the term "elastic-plastic deformable" preferably means that elastic restoring forces are active in the material after a bending process, as is typically the case for synthetic materials for which only a part of the bending takes place with a plastic, irreversible deformation. Further, the term "poor heat conducting" preferably means that the heat conduction value X, is less than or equal to about 0.3 W/(mK).

The first material is preferably a synthetic material, more preferably a polyolefin and still more preferably polypropylene, polyethylene terephthalate, polyamide or polycarbonate. An example of such a polypropylene is Novolen® 1040K. The first material preferably has an E-modulus of less than or equal to about 2200 N/mm$^2$ and a heat conduction value λ, less than or equal to about 0.3 W/(mK), preferably less than or equal to about 0.2 W/(mK).

The profile body 10 is firmly bonded (e.g., fusion and/or adhesive bonded) with a one-piece diffusion barrier film 30. The diffusion barrier film 30 is formed from a second material. The second material is preferably a plastic deformable material. Herein, the term "plastic deformable" preferably means that practically no elastic restoring forces are active after the deformation. This is typically the case, for example, when metals are bent beyond their elastic limit (apparent yield limit). Preferably, the second material is a metal, more preferably stainless steel or steel having a corrosion protection of tin (such as tin plating) or zinc. If necessary or desired, a chrome coating or a chromate coating may be applied thereto.

Herein, the term "firmly bonded" preferably means that the profile body 10 and the diffusion barrier film 30 are durably connected with each other, e.g. by co-extrusion of the profile body with the diffusion barrier film, and/or if necessary, by the application of an adhesive material. Preferably, the cohesiveness of the connection is sufficiently large that the materials are not separable in the peel test according to DIN 53282.

Furthermore, the diffusion barrier film additionally also preferably acts as a reinforcement element. Its thickness (material thickness) d1 is preferably less than or equal to about 0.30 mm, more preferably less than or equal to 0.20 mm, still more preferably less than or equal to 0.15 mm, still more preferably less than or equal to 0.12 mm, and still more preferably less than or equal to 0.10 mm. Moreover, the thickness d1 preferably is greater than or equal to about 0.10 mm, preferably greater than or equal to 0.08 mm, still preferably greater than or equal to 0.05 mm and still preferably greater than or equal to 0.03 mm. The maximum thickness is chosen so as to correspond to the desired heat conduction value. As the film is made thinner, the "warm edge" conditions will be increasingly fulfilled. Each of the embodiments shown in the figures preferably has a thickness in the range of 0.05 mm-0.13 mm.

The preferred material for the diffusion barrier film is steel and/or stainless steel having a heat conduction value of λ, less than or equal to about 50 W/(mK), more preferably less than or equal to about 25 W/(mK) and still more preferably 15 less than or equal to W/(mK). The E-modulus of the second material preferably falls in the range of about 170-240 kN/mm$^2$ and is preferably about 210 kN/mm$^2$. The breaking elongation of the second material is preferably greater than or equal to about 15%, and more preferably greater than or equal to about 20%. An example of stainless steel film is the steel film 1.4301 or 1.4016 according to DIN EN 10 08812 having a thickness of 0.05 mm and an example of a tin plate film is a film made of Antralyt E2, 8/2, 8T57 having a thickness of 0.125 mm Further details of the materials that may be advantageously used with the present teachings are described in greater detail in EP 1 017 923 A1/B1 (U.S. Pat. No. 6,339,909), the contents of which are incorporated herein by reference.

The profile body 10 comprises an inner wall 13 and an outer wall 14 separated by a distance h2 in the height direction Y and two side walls 11, 12 that are separated by a distance in the traverse direction X, and extend essentially in the height direction Y. The side walls 11, 12 are connected via the inner wall 13 and outer wall 14, so that a chamber 20 is formed for accommodating hygroscopic material. The chamber 20 is defined on its respective sides in cross-section by the walls 11-14 of the profile body. The chamber 20 comprises a height h2 in the height direction Y. The side walls 11, 12 are formed as attachment bases for attachment to the inner sides of the window panes. In other words, the spacer profile is preferably adhered to the respective inner sides of the window panes via these attachment bases (see FIG. 1).

The inner wall 13 is defined herein as the "inner" wall, because it faces inward toward the intervening space between the window panes in the assembled state of the spacer profile. This side of the spacer profile, which faces towards the intervening space between the window panes, is designated in the following description as the inner side in the height direction of the spacer profile. The outer wall 14, which is arranged in the height direction Y on the opposite side of the chamber 20, faces away from the intervening space between the window panes in the assembled state and therefore is defined herein as the "outer" wall.

According to the W-configuration shown in FIG. 4*a*), the side walls 11, 12 each comprise a concave portion, when observed from outside of the chamber 20, which concave portion forms the transition or segue of the outer wall 14 to the corresponding side wall 11, 12. As a result of this design, the heat conduction path via the metal film is elongated as compared to the U-configuration shown in FIG. 4*a*), even though the W- and U-configurations have the same height h1 and width b1. In exchange, the volume of the chamber 20, with the same width b1 and height h1, is slightly reduced.

Openings 15 are formed in the inner wall 13, independent of the choice of the material for the profile body, so that the inner wall 11 is not formed to be diffusion-proof. In addition or in the alternative, to achieve a non-diffusion-proof design, it is also possible to select the material for the entire profile body and/or the inner wall, such that the material permits an equivalent diffusion without the formation of the openings 15. However, the formation of the openings 15 is preferable. In any case, moisture exchange between the intervening space between the window panes and the hygroscopic material in the chamber 20 in the assembled state is preferably ensured (see also FIG. 1).

The diffusion barrier film 30 is formed on the outer sides of the outer wall 14 and the side walls 11, 12, which face away from the chamber 20. The film 30 extends along the side walls in the height direction Y up to height h2 of the chamber 20. Adjacent thereto, the one-piece diffusion barrier film 30 comprises profiled elongation portions 31, 32, each having a profile 31*a*, 32*a*.

Herein, the term "profile" preferably means that the elongation portion is not exclusively a linear elongation of the diffusion barrier film 30, but instead that a two-dimensional profile is formed in the two-dimensional view of the cross-section in the X-Y plane, which profile is formed, for example, by one or more bends and/or angles in the elongation portion 31, 32.

Figure 4:
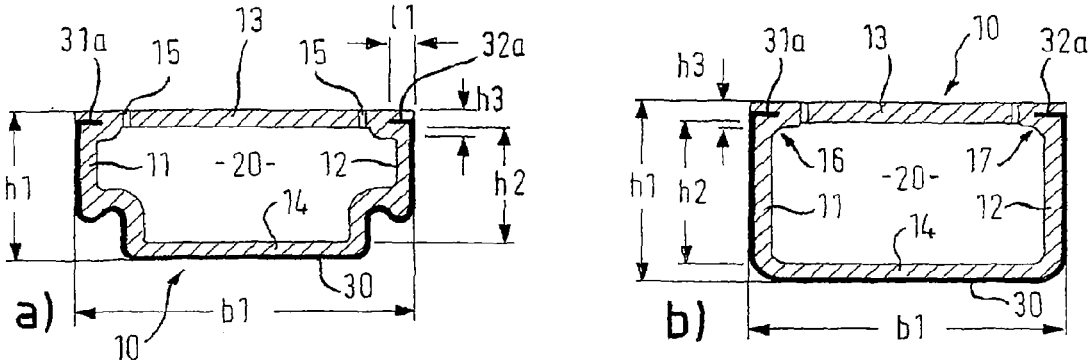
FIGS. 4*a*) and 4*b*) show cross-sectional views of a spacer profile according to a first embodiment, respectively in a W-configuration and in a U-configuration.

According to the embodiment shown in FIG. 4, the profile 31*a*, 32*a* comprises a bend) (90°) and a portion (flange) directly adjacent thereto, which portion (flange) extends a length 11 in the traverse direction X from the outer edge of the corresponding side wall 11, 12 toward the interior.

For the firmly bonded connection of the profile body 10 and the diffusion barrier film 30, at least one side of the diffusion barrier profile is preferably firmly bonded to the profile body. According to the embodiment shown in FIG. 4, the largest part of the elongation portion is completely enclosed by the material of the profile body. The elongation portion is preferably disposed as close as possible to the inner side of the spacer profile.

On the other hand, for purely ornamental reasons, the diffusion barrier film preferably should not be visible through the window panes of the assembled insulating window unit. Therefore, the film preferably should be covered at the inner side by the material of the profile body. One embodiment, in which this is not the case, will be described later with reference to FIG. 6.

In summary, the elongation portion should preferably be close to the inner side. Therefore, the region of the profile body (accommodation region), in which the elongation portion is located (is accommodated), preferably should be clearly above the mid-line of the profile in the height direction. In such case, the dimension (length) of the accommodation region from the inner side of the spacer profile in the Y-direction should not extend over more than 40% of the height of the spacer profile. In other words, the accommodation region 16, 17 comprises a height h3 in the height direction and the height h3 should be less than or equal to about 0.4 h1, preferably less than or equal to about 0.3 h1, more preferably less than or equal to about 0.2 h1 and still more preferably less than or equal to about 0.1 h1.

Moreover, it is advantageous if the mass (weight) of the elongation portion comprises at least about 10% of the mass (weight) of the remaining part of the diffusion barrier film, which is above the mid-line of the spacer profile in the height direction, preferably at least about 20%, more preferably at least about 50% and still more preferably about 100%.

All details concerning the first embodiment also apply to all the other described embodiments, except when a difference is expressly noted or is shown in the figures.

In FIGS. 5*a*) and 5*b*), a spacer profile according to a second embodiment is shown in cross-section in the X-Y plane.

The second embodiment differs from the first embodiment in that the elongation portions 31, 32 are almost double the length of the first embodiment, whereby the elongation length 11 stays the same. This is achieved by including a second bend (180°) in the profiles 31*b*, 32*b* and by extending the portion of the elongation portion, which is continuous with the second end, likewise in the traverse direction X, but now to the outside. A substantially longer length of the elongation portion is thereby ensured, whereby the closest possible proximity to the inner side of the spacer profile is maintained.

In addition, a part of the material of the profile body is enclosed on three sides by the profiles 31*b*, 32*b*. These enclosures result in that, during a bending process that includes compression, the enclosed material acts as an essentially incompressible volume element.

Figure 6:
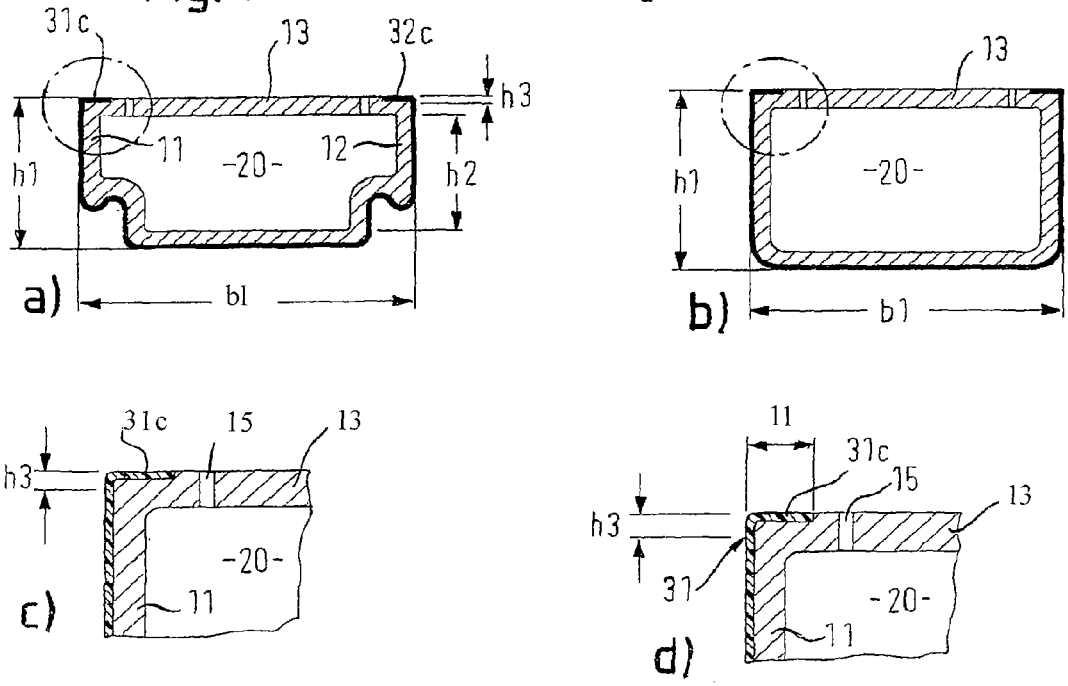
FIGS. 6*a*) and 6*b*) show cross-sectional views of a spacer profile according to a third embodiment, respectively in a W-configuration and in a U-configuration.
FIG. 6*c*) shows an enlarged view of the portion encircled by a circle in FIG. 6*a*) and FIG. 6*d*) shows an enlarged view of the portion encircled by a circle in FIG. 6*b*).
Figure 7:
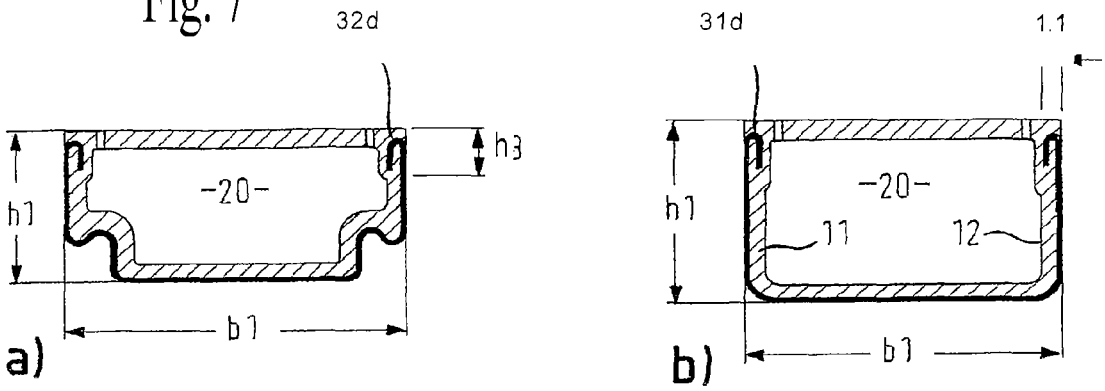
FIGS. 7*a*) and 7*b*) show a cross-sectional view of a spacer profile according to a fourth embodiment, respectively in a W-configuration and in a U-configuration.

Referring to FIGS. 6*a*) and 6*b*), a spacer profile according to a third embodiment will be described, wherein the areas surrounded by a circle respectively in views a) and b) are shown enlarged in FIGS. 6*c*) and d). According to the embodiment shown in FIG. 6, the diffusion barrier film 30, inclusive of the elongation portions 31, 32, extends completely along the outside of the profile body 10. The elongation portions 31, 32 and their profiles 31*c*, 32*c* are thus visible on the inner side (the "outside" facing the space between the window panes) in the assembled state, because the elongation portions 31, 32 are not covered at the inner side by the material of the profile body, but rather are exposed. According to this embodiment, the elongation portion is arranged as close as possible to the inner side.

Figure 5:
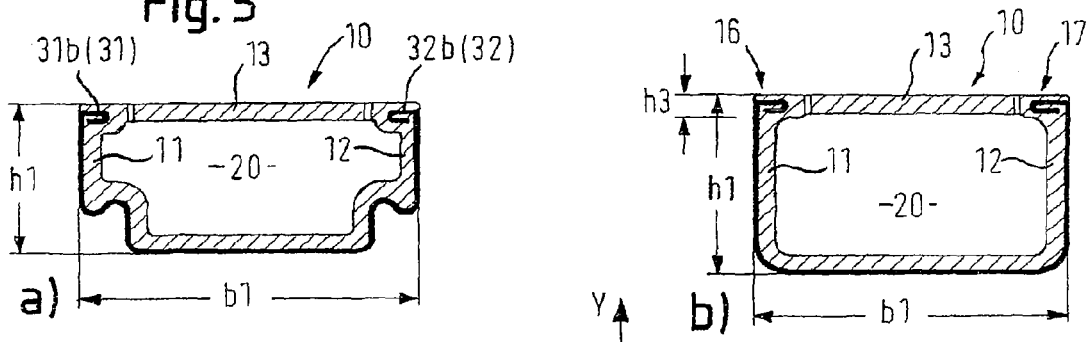
FIGS. 5*a*) and 5*b*) show cross-sectional views of a spacer profile according to a second embodiment, respectively in a W-configuration and in a U-configuration.
Figure 5:
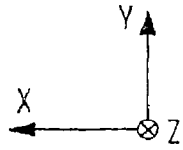

The embodiment shown in FIG. 6 could be modified so that the elongation portion 31, 32 is elongated and, similar to the embodiment shown in FIG. 5 (or also in FIGS. 7-9), extends into the interior of the accommodation region 16, 17. Naturally, the height h3 shown in FIG. 6*c*) and d) would then be correspondingly longer.

In FIGS. 7*a*) and b), cross-sectional views of a spacer profile according to a fourth embodiment are shown. The fourth embodiment differs from the first embodiment, in that the bend is not a 90° bend, but rather is a 180° bend. Consequently, the bend-adjacent portion of the elongation portion next to the profiles 31*d*, 32*d* does not extend in the traverse direction X, but rather extends in the height direction Y. Therefore, the three-sided enclosure of a part of the material of the profile body reaches into the accommodation regions 16, 17, although only one bend is present. Therefore, as in the previous embodiment, during bending of the spacer profile with compression, a volume element is present that can effectively act as an essentially incompressible volume element.

In FIGS. 8*a*) and 8*b*), cross-sectional views of a spacer profile according to a fifth embodiment are shown. The fifth embodiment differs from the fourth embodiment merely in that the curvature radius of the bend of the profile 31*e*, 32*e* is smaller than in the fourth embodiment.

In FIGS. 9*a*) and 9*b*), cross-sectional views of a spacer profile according to a sixth embodiment are shown. The sixth embodiment differs from the first to fifth embodiments, which are shown in FIGS. 4-8, in that the profiles 31*f*, 32*f* comprise first a bend of about 45° towards the interior, then a bend of about 45° in the opposite direction and finally a 180° bend having a corresponding three-sided embedding of a part of the material of the profile body.

In FIGS. 10*a*) and 10*b*), comparison examples of spacer profiles having the W-configuration and the U-configuration are shown, which comparison examples do not comprise a profiled elongation portion. FIG. 10*c*) shows a table with measurement values for the test arrangement according to FIG. 3*b*). In the test arrangement of FIG. 3*b*), a spacer profile lies on two supports separated by distance L, whereby the sag D is measured as compared to an ideal not-sagging profile (i.e. a straight line between the two support points). For the data provided in the table of FIG. 10*c*), L=2000 mm, b1=15.3 mm, h1 for the W-configuration=7 mm and b1=13.3 mm, h1 for the U-configuration=8.4 mm. For all embodiments of the profile, the same materials, material thickness, wall thickness, etc., were utilized. The data are partially based upon measurements and partially upon calculations.

Figure 10:
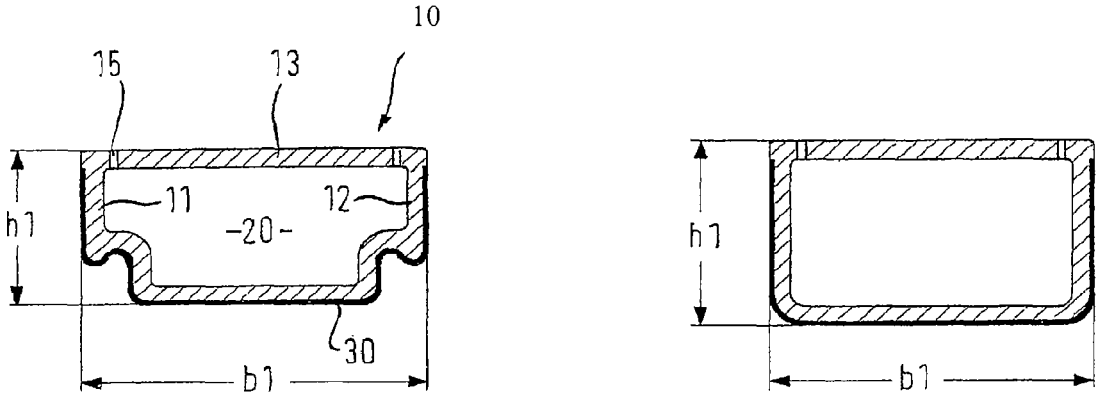
FIGS. 10*a*) and 10*b*) show cross-sectional views of a spacer profile according to a comparison example (i.e. not having a profiled elongation portion), respectively in a W-configuration and in a U-configuration.
FIG. 10*c*) shows a table with values for the spacer profiles according to FIG. 4-10 that were evaluated in a test arrangement according to FIG. 3.
Figures 11, 12:
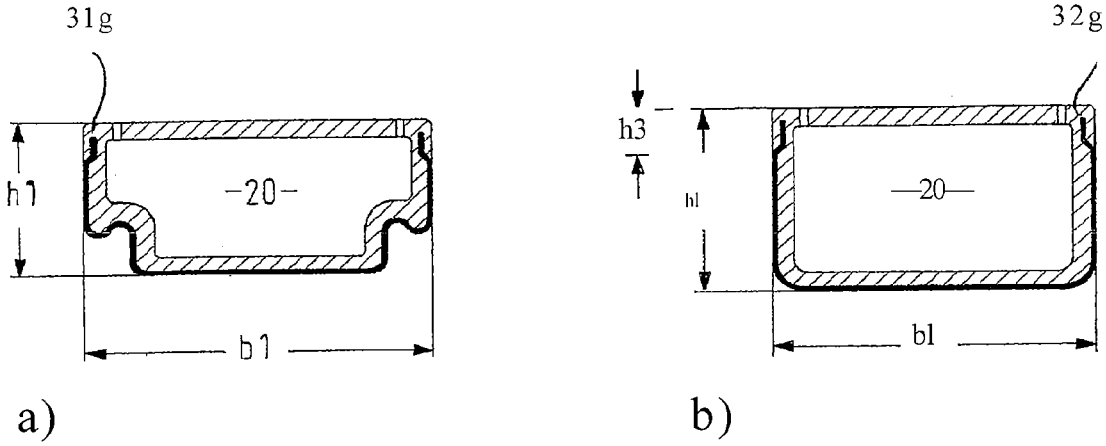
FIG. 12 shows a table representing evaluation results of the wrinkle formation behavior of the spacer profiles of FIG. 4-11.

The reduction of the sag for all embodiments shown in FIGS. 4-9, as compared to the spacer profiles of FIG. 10, was remarkably nearly 20% or more.

In FIGS. 11*a*) and b), cross-sectional views of a spacer profile according to a seventh embodiment are shown. The seventh embodiment differs from the sixth embodiment, in that a 180° bend is not present in the profiles 31*g* and 32*g*.

Figure 3:
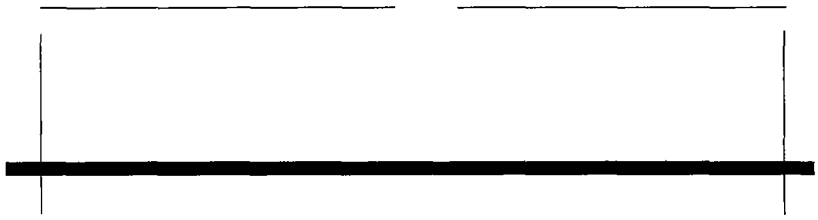
FIG. 3*a*) shows a side view, partially cut away, of a spacer frame bent from a spacer profile in a real condition with an illustrated sag (droop or downward deformation) between imaginary supports on the upper bar.
FIG. 3*b*) shows an imaginary test arrangement.
FIG. 3*c*) shows the wrinkle formation at a bend.
Figure 3:
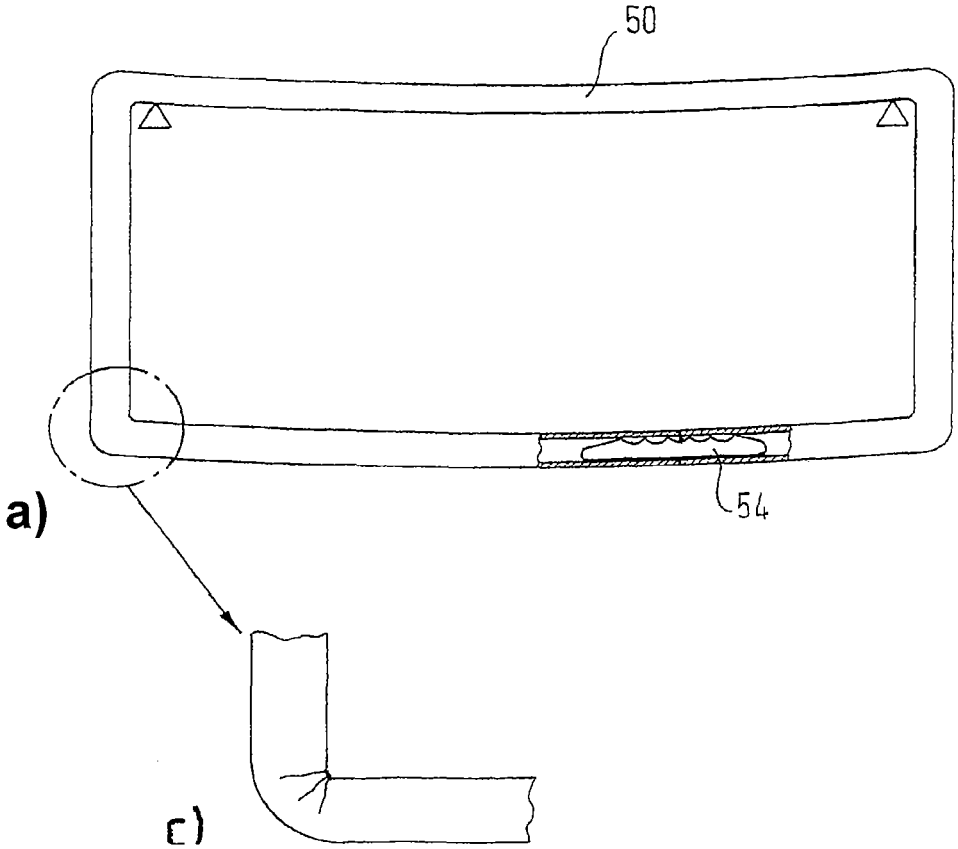

For spacer profiles according to the present teachings, it was also determined that the wrinkle formation in the bends, as represented schematically in FIG. 3*c*), for all embodiments, which are shown in FIGS. 4-9 and 11, was significantly reduced as compared to the comparison examples of FIG. 10. In other words, the number of wrinkles and/or the length of the wrinkles were reduced in the bent spacer profiles according to the present teachings. The wrinkle formation behavior of the respective spacer profiles, which was evaluated based upon the number of wrinkles and/or the lengths of the wrinkles, is represented in the table of FIG. 12, in which "+" means reduced wrinkle formation and "++" means significantly reduced wrinkle formation with respect to the comparison example (FIG. 10).

Further modifications of the profile of the elongation portions 31, 32 are naturally conceivable. For example, additional bends, a larger extension in the X-direction, etc., may be provided.

The significant reduction of the wrinkle formation in the bends results in that better adhesion and sealing with the inner side of the window panes can be achieved. The reduction of the sag results in that, in particular for large spacer profile frames, i.e. for large window widths, less manual effort is required to affix the spacer profile so as to prevent any visible sag.

Figure 1:
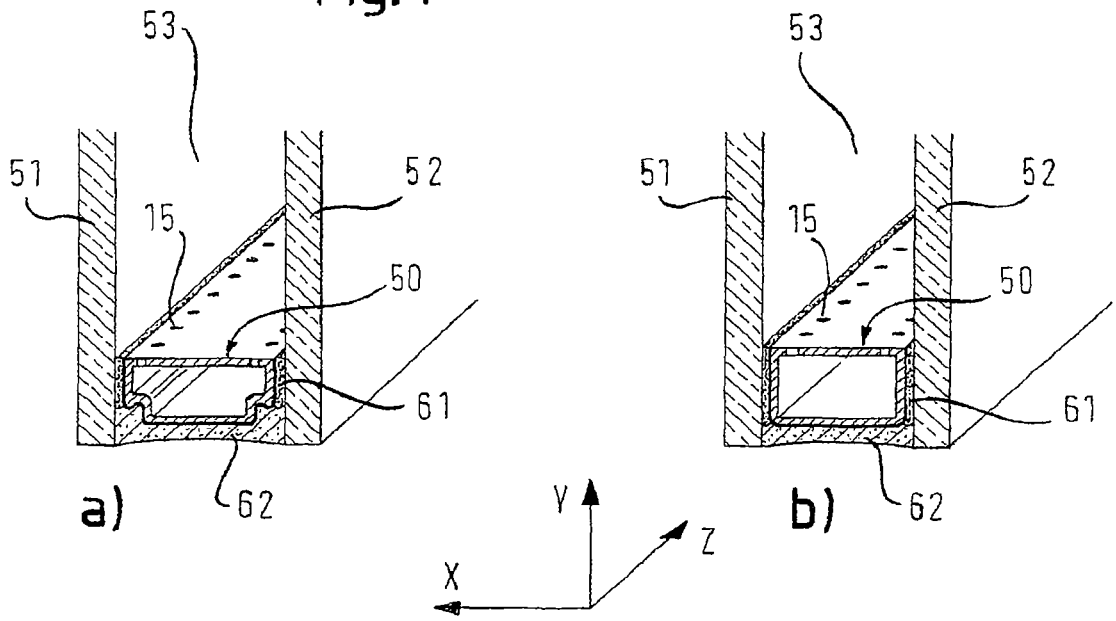
FIGS. 1*a*) and b) respectively show perspective cross-sectional views of the configuration of the window pane in an insulating window unit, in which a spacer profile, adhesive material and sealing material are arranged therebetween.
Figure 2:
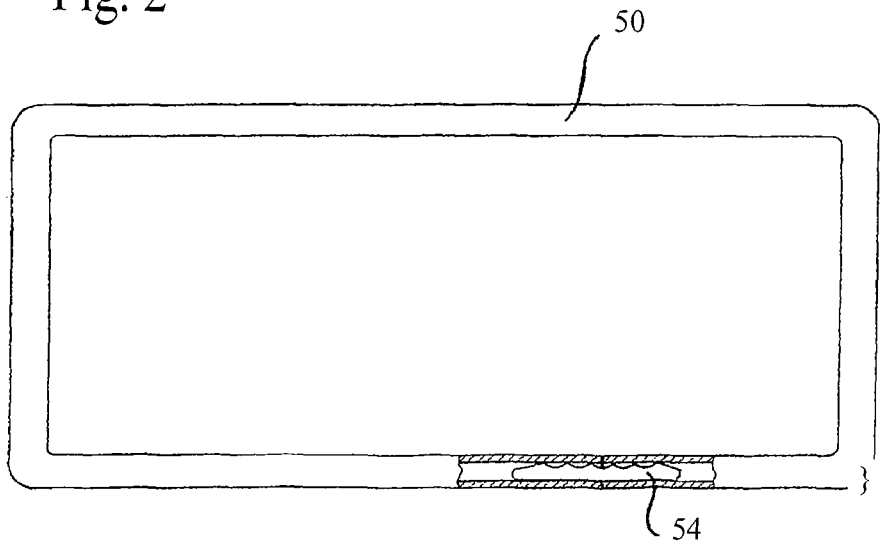
FIG. 2 shows a side view, partially cut away, of a spacer frame bent from a spacer profile in the ideal condition.

A spacer profile frame made of a spacer profile according to one of the above-described embodiments results also in that the ultimately obtained frame is closer to the ideal form, which is shown in FIG. 2, than the less ideal form, which is shown in FIG. 3*a*). The spacer profile frame, whether it is produced from one-piece by bending, preferably cold bending, or it is produced from several straight individual pieces using corner connectors, is used in an insulating window unit, e.g. in the form shown in FIG. 1. In FIG. 1, the elongation portions are not depicted.

As is shown in FIG. 1, the side walls 11, 12 formed as attachment bases are adhered with the inner sides of the window panes 51, 52 using an adhesive material (primary sealing compound) 61, e.g., a butyl sealing compound based upon polyisobutylene. The intervening space 53 between the window panes is thus defined by the two window panes 51, 52 and the spacer profile 50. The inner side of the spacer profile 50 faces the intervening space 53 between the window panes 51, 52. On the side facing away from the intervening space 53 between the window panes in the height direction Y, a mechanically stabilizing sealing material (secondary sealing compound), for example based upon polysulfide, polyurethane or silicon, is introduced into the remaining, empty space between the inner sides of the window panes in order to fill the empty space. This sealing compound also protects the diffusion barrier layer from mechanical or other corrosive/degrading influences.

As was already mentioned above, the diffusion barrier film 30 with the profile body 10 is achieved by co-extrusion in firmly bonding contact. According to the embodiments shown in FIGS. 4, 5, 7-9 and 11, more than just one side of the diffusion barrier profile formed by a metal film comes into contact with the material, preferably synthetic material, of the profile body. In particular, by using synthetic material and metal, the firmly bonded connection, i.e. the adhesion, between the metal and the synthetic material is to be ensured by an adhesive material applied to the metal film.

Methods for manufacturing a spacer profile (50) for use as a spacer profile frame, which is suitable for mounting in and/or along the edge area of an insulating window unit for forming and maintaining an intervening space (53) between window panes (51, 52), may comprise the steps of forming one or more chambers (20) in a profile body (10) made of synthetic material. Either simultaneous with or subsequent to the chamber forming step, a metal film (30) may be disposed on and/or in at least three sides of the profile body (10) such that, when bent, a fourth, uncovered side of the profile body (10) will be directed towards the intervening space (53) between the window panes (51, 52) in the assembled insulating window unit, the metal film causing the at least three covered sides to be substantially gas impermeable, whereas the fourth side of the profile body (10) is gas permeable. Each end of the metal film (30) is preferably formed with a profile (31*a-g*, 32*a-g*) having at least one edge or bend.

Each of the various features and teachings disclosed above may be utilized separately or in conjunction with other features and teachings to provide improved spacer profiles, and insulating window units and methods for designing, manufacturing and using the same. Representative examples of the present invention, which examples utilize many of these additional features and teachings both separately and in combination, were described above in detail with reference to the attached drawings. This detailed description is merely intended to teach a person of skill in the art further details for practicing preferred aspects of the present teachings and is not intended to limit the scope of the invention. Therefore, combinations of features and steps disclosed in the detailed description may not be necessary to practice the invention in the broadest sense, and are instead taught merely to particularly describe representative examples of the present teachings.

Moreover, the various features of the representative examples and the dependent claims may be combined in ways that are not specifically and explicitly enumerated in order to provide additional useful embodiments of the present teachings. In addition, it is expressly noted that all features disclosed in the description and/or the claims are intended to be disclosed separately and independently from each other for the purpose of original disclosure, as well as for the purpose of restricting the claimed subject matter independent of the compositions of the features in the embodiments and/or the claims. It is also expressly noted that all value ranges or indications of groups of entities disclose every possible intermediate value or intermediate entity for the purpose of original disclosure, as well as for the purpose of restricting the claimed subject matter.

The contents of U.S. Pat. Nos. 5,313,761, 5,675,944, 6,038,825, 6,068,720 and 6,339,909, US Patent Publication No. 2005-0100691 and U.S. patent application Ser. No. 11/038,765 provide additional useful teachings that may be combined with the present teachings to achieve additional embodiments of the present teachings, and these patent publications are hereby incorporated by reference as if fully set forth herein.

The invention claimed is:

1. A spacer profile for use as a spacer profile frame for an edge area of an insulating window unit for forming and maintaining an intervening space between window panes of the insulating window unit, the spacer profile comprising:

a profile body comprising a material, the profile body further configured to form, in a bent state of the spacer profile, a first window side and a second window side facing the respective window panes, an inner side directed towards the intervening space between the window panes, and an outer side directed away from the intervening space, the profile body defining a chamber within the material; and, a metal film comprising a first section extending on the first window side, an outer section extending on the outer side, and a second section extending on the second window side of the profile body, and the first section and the second section each comprises a profile section extending respectively towards the other of the first section and the second section and each profile section extending into the material of the profile body, thereby providing an additional amount of the metal film adjacent to the intervening space.

2. The spacer profile of claim 1, wherein the profile section includes at least one edge or bend at each end of the metal film and the at least one edge or bend is completely enclosed by the material.

3. The spacer profile of claim 1, wherein the chambers is laterally defined by side walls and is configured for accommodation of hygroscopic material.

4. The spacer profile of claim 3, wherein the side walls are formed as an attachment base for attachment to inner sides of the window panes.

5. The spacer profile of claim 1, wherein
the material is a synthetic material.

6. The spacer profile of claim 1, wherein
the metal of the metal film is selected from the group consisting of stainless steel, steel having a corrosion protection made of tin plating, and steel having a corrosion protection made of zinc.

7. The spacer profile of claim 1, wherein
the metal film has a thickness d1, greater than or equal to 0.03 mm and less than or equal to 0.20 mm.

8. The spacer profile of claim 7, wherein
the thickness d1 of the metal film is greater than or equal to 0.03 mm and less than or equal to 0.10 mm.

9. The spacer profile of claim 1, wherein
the spacer profile is cold bendable.

10. The spacer profile of claim 1, wherein
a mass of the additional amount of the metal film comprises about 10% or more of the mass of the remaining part of the metal film, which is above the mid-line of the spacer profile in the height direction.

11. The spacer profile of claim 1, wherein
a mass of the additional amount of the metal film comprises about 50% or more of the mass of the remaining part of the metal film, which is above the mid-line of the spacer profile in the height direction.

12. The spacer profile of claim 1, wherein:
the first and second sections are each formed to have the at least one edge or bend at each end of the metal film extending respectively towards the other of the first section and the second section, thereby providing the inner side of the profile body with an additional amount of the metal film adjacent the intervening space relative to the outer side of the profile body.

13. A spacer profile (50) for use as a spacer profile frame for an edge area of an insulating window unit for forming and maintaining an intervening space (53) between window panes (51, 52), wherein the spacer profile extends in a longitudinal direction (Z) and comprises a first width b1 in a traverse direction (X), which is perpendicular to the longitudinal direction (Z), and comprises first height (h1) in a height direction (Y), which is perpendicular to the longitudinal direction (Z) and to the traverse direction (X), and wherein in the height direction (Y) the spacer profile comprises an inner side (13), which is arranged to face towards the intervening space (53) between the window panes (51, 52) in the assembled state of the spacer profile frame, the spacer profile (50) comprising:

a profile body (10) formed from a first material and defining therein a chamber (20) for accommodation of hygroscopic material, wherein the chamber: (i) is laterally defined in the traverse direction by side walls (11, 12), (ii) comprises a second height (h2) in the height direction (Y) and (iii) is formed so as to be not diffusion-proof in the height direction (Y) on the inner side (13) of the profile body (10), and a one-piece diffusion barrier film (30) formed of a second material having a first thickness (d1) less than 0.3 mm, wherein the film (30) is firmly bonded with the profile body (10), so that the film extends over an outer side (14) of the chamber (20) that faces away from the inner side (13) and, continuous thereto in the height direction (y), essentially extends over the side walls (11, 12) up to the height of the chamber (20), wherein the corresponding side walls (11, 12) are an attachment base for attachment to the inner side of the window panes, the diffusion barrier film (30), as seen in cross-section perpendicular to the longitudinal direction (Z), comprises two ends and on at least one of the ends a profiled elongation portion (31*a-g*, 32*a-g*), whose profile is fully contained in an accommodation region (16, 17), which accommodation region adjoins the inner side (13) of the spacer profile (50) in the height direction (Y) and extends within the side walls (11, 12) in the height direction (Y) from the inner side (13) in the direction facing away from the intervening space (53) between the window panes (51, 52), and the mass of the elongation portion comprises at least 20% of the mass of the remaining part of the diffusion barrier film above the mid-line of the spacer profile in the height direction.

14. The spacer profile according to claim 13, wherein
the mass of the elongation portion (31, 32) comprises at least 50% of the mass of the remaining part of the diffusion barrier film above the mid-line of the spacer profile in the height direction.

15. An insulating window unit comprising:

at least two window panes (51, 52) arranged to oppose each other with a separation distance therebetween so as to form an intervening space (53) between the window panes (51, 52), wherein the insulating window unit comprises a spacer profile frame formed from a spacer profile (50) according to claim 1 or claim 13 and at least partially defining the intervening space (53) between the window panes (51, 52), wherein the attachment bases of the spacer profile (50) are adhered with a diffusion-proof adhesive material (61) essentially along their entire length and height with the inner side of the window panes (51, 52) that faces thereto, and the remaining empty space between the inner sides of the window panes (51, 52) on the side of the spacer profile frame and the adhesive material (61) that faces away from the intervening space (53) between the window panes (51, 52) is filled with a mechanically stabilizing sealing material (62).

* * * * *